US005499945A

United States Patent [19]

Ferlin et al.

[11] Patent Number: 5,499,945

[45] Date of Patent: Mar. 19, 1996

[54] VENTILATION APPARATUS PROVIDING AIR EXTRACTION ADJACENT SELECTED WORKSTATIONS IN A CONFINED SPACE

[76] Inventors: Keith A. Ferlin, 6302 Peach Orchard Road, Summerland, Canada, V0H 1Z0; Morris P. Kemps, 564 Braid Street, Penticton, Canada, V2A 4Y3

[21] Appl. No.: 347,867

[22] Filed: Dec. 1, 1994

[51] Int. Cl.[6] ..... B08B 15/02

[52] U.S. Cl. ..... 454/49; 454/65; 454/344; 454/345

[58] Field of Search ..... 454/49, 63, 65, 454/344, 345, 903

[56] References Cited

U.S. PATENT DOCUMENTS

| | | | |
|---|---|---|---|
| 840,894 | 1/1907 | Allington | 454/49 X |
| 1,046,884 | 12/1912 | Spencer . | |
| 1,048,477 | 12/1912 | Allington | 454/63 X |
| 2,361,861 | 10/1944 | Masowich | 454/63 X |
| 2,644,391 | 7/1953 | Shaw | 454/49 |
| 4,253,821 | 3/1981 | Bradshaw | 454/49 X |
| 4,787,298 | 11/1988 | Hon | 454/345 |

FOREIGN PATENT DOCUMENTS

| | | | |
|---|---|---|---|
| 227196 | 8/1943 | Switzerland | 454/65 |
| 705949 | 3/1954 | United Kingdom | 454/344 |
| 93/00029 | 7/1993 | WIPO | 454/49 |

*Primary Examiner*—Harold Joyce
*Attorney, Agent, or Firm*—Dalesman & Company

[57] ABSTRACT

An exhaust ventilation apparatus to be temporarily mounted in a continuous pulp digester or similar elongated vessel to provide local air ventilation from one or more selected worksites in the vessel. An exhaust duct extending upwardly to an outlet opening has numerous inlet ports spaced along it. Venturi type air movers each having an air collection conduit attached to it are connected to several of the inlet ports of the exhaust duct. Each air collection conduit is mounted with an inlet located near one of the selected worksites to draw polluted air out of the vessel through the exhaust duct. The air movers and/or the air collection conduits are easily movable as work progresses.

5 Claims, 3 Drawing Sheets

VENTILATION APPARATUS PROVIDING AIR EXTRACTION ADJACENT SELECTED WORKSTATIONS IN A CONFINED SPACE

BACKGROUND OF THE INVENTION

This invention relates to apparatus to provide exhaust ventilation by drawing air from one or more worksites in a large vessel.

While this invention has particular application to a continuous pulp digester of the KAMYR type which can be several hundred feet high, the term vessel is used herein to also include similar structures enclosing a confined space such as precipitators, storage tanks and refining columns. These types of large vessels require temporary ventilation when they are shut down periodically for maintenance and/or cleaning. Ventilation can be of the vessel as a whole which is referred to as general ventilation, or of specific areas or worksites which is referred to as local ventilation. In the past, only general ventilation has normally been provided to these types of vessels by mounting exhaust fans at an opening at the top end and/or blowers at an opening at the bottom end. An example of general ventilation apparatus mounted in a continuous pulp digester is shown in the applicants' Canadian Patent Application Serial Number 2,067,326 entitled "Digester Ventilation and Utility Module" which was published Oct. 28, 1993. While general ventilation is satisfactory for some situations, it is entirely inadequate if work, particularly welding is being done simultaneously at different elevations in the vessel. It will be appreciated that under such circumstances, the air in the vessel quickly becomes polluted with gases, fumes, smoke and particles which are very unpleasant and unhealthy. At present, using general ventilation to adequately clean the atmosphere requires an air velocity sufficient to suspend metal particles, as a result of grinding and arc air gouging, thereby causing numerous eye injuries. On the other hand, U.S. Pat. No. 1,046,884 to Spencer which issued Dec. 10, 1912 shows the concept similar to a central vacuum system of having a single air mover to which a number of different intake heads are connected. While this is also satisfactory for some situations, it has the disadvantages for a confined space in a high vessel that the single air mover must be extremely powerful and the exhaust duct must be very large. Thus, it is relatively costly and difficult to install, particularly in a crowded vessel where space to work is very limited.

SUMMARY OF THE INVENTION

Accordingly, it is an object of the present invention to at least partially overcome the disadvantages of the prior art by providing apparatus for local exhaust ventilation of one or more selected worksites in a large vessel.

To this end, in one of its aspects, the invention provides an exhaust ventilation apparatus to be temporarily mounted in an elongated vessel having an outer casing to draw air from at least one selected worksite in the vessel comprising an exhaust duct to extend longitudinally in the vessel to an outlet opening in the outer casing of the vessel, the exhaust duct having a plurality of normally closed inlet ports spaced therealong, at least one air collection conduit to extend from an inlet positioned adjacent said at least one selected worksite and connect to a convenient one of the inlet ports spaced along the exhaust duct, and at least one air mover to be connected to the at least one air collection conduit between said inlet and said convenient one of the inlet ports, whereby air from said at least one selected worksite is continuously drawn into the exhaust duct through the at least one air collection conduit and exhausted out of the vessel through the exhaust duct outlet.

Further objects and advantages of the invention will appear from the following description taken together with the accompanying drawings.

DETAILED DESCRIPTION OF THE INVENTION

Figure 1:
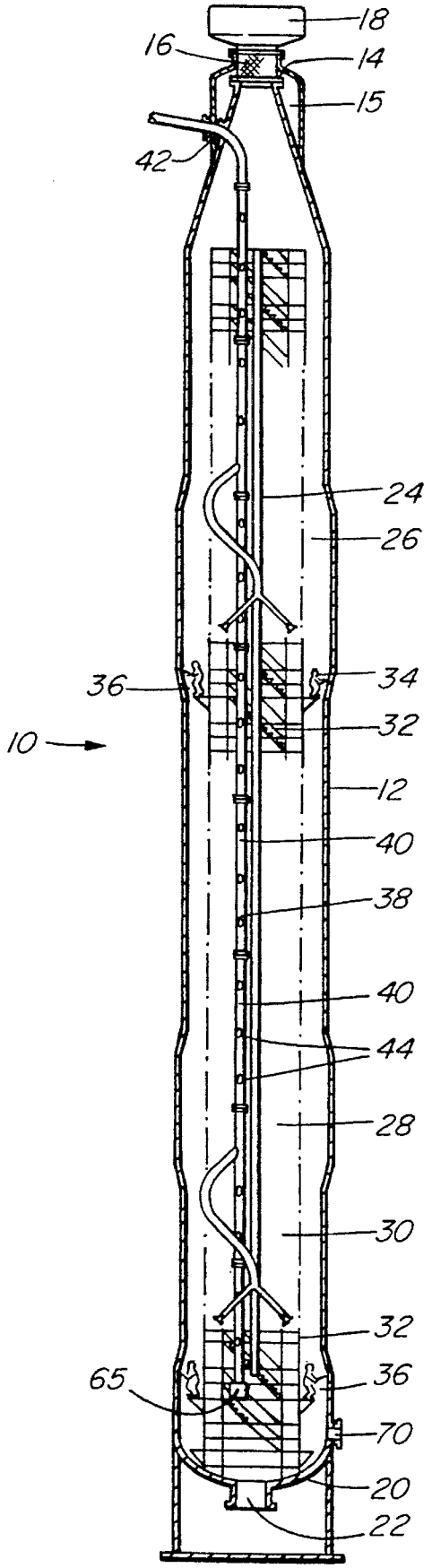
FIG. 1 is a partial sectional view of a large vessel such as a continuous pulp digester with exhaust ventilation apparatus according to one embodiment of the invention.

Reference is first made to FIG. 1 which shows a continuous pulp digester 10 of the KAMYR type which has been shut down for periodic maintenance and cleaning. The digester 10 is quite tall and has a generally cylindrical outer wall or casing 12 made of steel. While this type of digester has been shown, the exhaust ventilation apparatus according to the invention is also suitable for other types of elongated vessels which enclose a confined space such as precipitators, storage tanks and refining columns. The digester 10 has a top end 14 surrounded by a compression chamber 15 and is closed by a removable screen 16 and separator 18, and a bottom end 20 with a central opening 22 through the casing 12. In use, pulp is fed in through the separator 18 and gradually flows downwardly around a central pipe 24 from an upper cooking zone 26, through a central extraction zone 28, to a lower wash zone 30. As can be seen, during shut down temporary scaffolding or staging 32 has been erected around the central pipe 24 to above the cooking zone 26 to provide access for welders 34 and others to repair and clean the digester. If work is being done simultaneously at several worksites 36 in the digester 10, then providing suitable and sufficient ventilation for them is even more critical.

Figure 2:
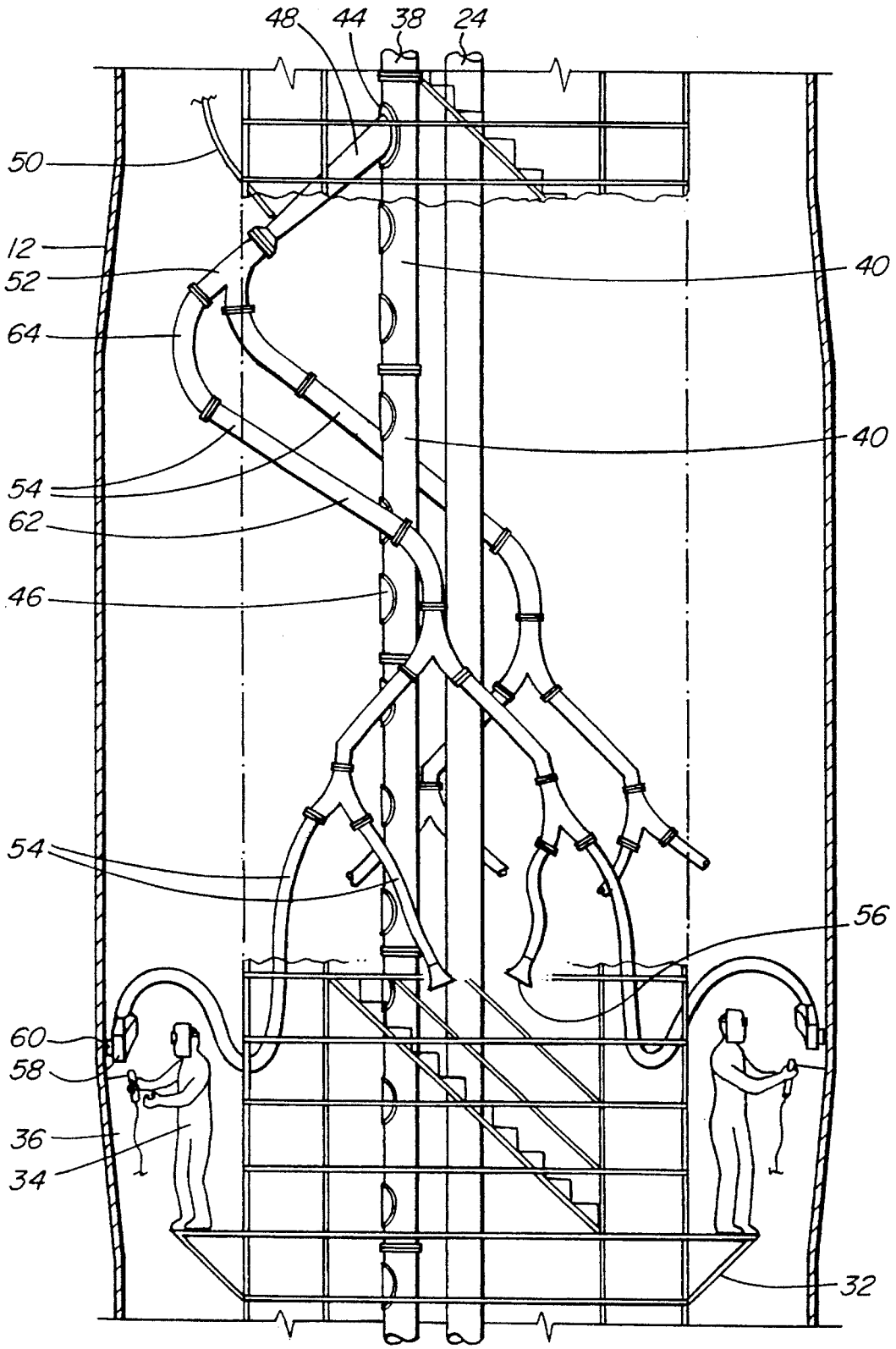
FIG. 2 is a partial sectional view of a portion of a digester as seen in FIG. 1 showing a portion of the exhaust ventilation apparatus in more detail.

As seen in FIG. 2, during erection of the staging 32 an exhaust duct 38 is also temporarily mounted to extend vertically beside the central pipe 24. In this embodiment, the exhaust duct 38 is built up from the bottom of aluminum sections 40 which are attached together, but may be made of plastic or other suitable materials in other embodiments. The exhaust duct 38 extends upwardly to an outlet opening 42 through the outer casing 12 of the digester and the surrounding compression chamber 15 where it discharges into the surrounding atmosphere. If the digester is contained in a building (not shown), then the exhaust duct 38 also extends to vent the fumes and gases outside of the building. The exhaust duct 38 has numerous inlet ports 44 which are spaced at different elevations along its length. Each of these round inlet ports 44 is normally closed by a removable cover 46. An air mover 48 is then connected to one of the inlet ports 44 a suitable distance above each of the worksites 36 to draw air into the exhaust duct 38. In this embodiment, each air mover 48 is a venturi type air mover such as a coppus air mover to which an air line 50 extends from an air compressor (not shown) in a conventional manner. An air collection conduit 52 is mounted to extend from each air mover 48. In the embodiment shown, each air collection conduit 52 has a number of branches 54, each of which extend out to an air inlet 56 positioned in a suitable location adjacent the worksite 36. Some of the inlets 56 have a head 58 to which a magnetic strip 60 is fastened to movably attach the inlet head 58 to the steel outer casing 12 just above where each welder 34 is working. In this embodiment, the air collection conduit 52 is made of a combination of aluminum sections 62 and flexible hosing 64, but other suitable light-weight materials can be used which facilitate installation, removal and repositioning of the inlets 56. While each air mover 48 is shown connected directly to one of the inlet ports 44 to the exhaust duct, in other configurations it can be mounted with a section of the air collection conduit 52 extending between it and the inlet port 44.

In use, the staging 32 and the exhaust ventilation apparatus is temporarily installed in a digester 10 or other suitable vessel which has been shut down for repairs. As seen in FIG. 1, a number of air movers 48 are connected to different selected inlet ports 44 to the exhaust duct 38, each having an air collection conduit 52 extending from one or more air inlets 56 positioned adjacent worksites 36 at different elevations in the digester 10. Compressed air supplied through air lines 50 to the air movers 48 produces a venturi effect which collects air from the different worksites 36 into the exhaust duct 38 and exhausts it out through the outlet opening 42. The air collection conduits 52 are convenient to move so the air inlets 56 can be quickly and easily repositioned near the work as it progresses. Thus, much of the pollution is eliminated at its source which prevents it from building up and drifting to other levels in the digester. If some of the multiple air inlets 56 are not required, they can be capped to ensure there is no loss of effectiveness of the system. Similarly, air movers 48 can easily be added, removed or relocated to different elevations depending upon the work schedule at any particular time. If necessary, two air movers 48 can be mounted to service a single worksite 36. On the other hand, if a light work schedule requires only a single crew, then a single air mover 48 may be sufficient by moving it from place to place. The exhaust duct 38 has a closed collection pot 65 which catches any particles which drop down and is cleaned out periodically.

Figure 3:
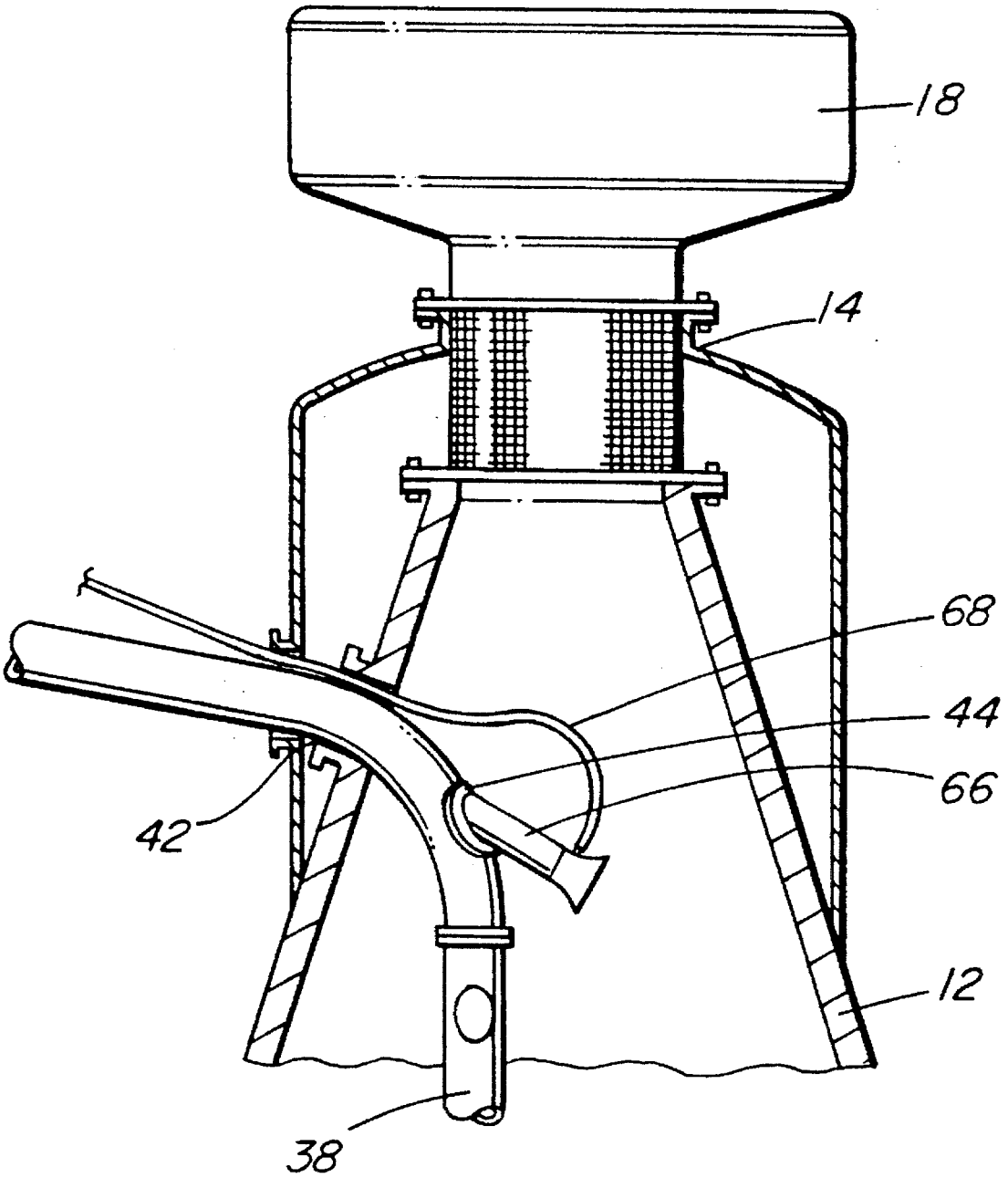
FIG. 3 is a partial sectional view showing the top end of a digester as seen in FIG. 1 with an air mover according to another embodiment of the invention.

Reference is now made to FIG. 3 which shows an alternate embodiment of the invention which in addition to the air movers 48 lower down has another air mover 66 connected to an inlet port 44 to the exhaust duct 38 near the top end 14 of the digester 10. This air mover 66 is also of the venturi type and has an air supply line 68 extending from an air compressor to draw air out of the digester. Thus, if required, this air mover 66 will provide general ventilation in the digester 10 with an upward circulation of air drawn in through the lower opening 22 and other manways 70 near the bottom end 20 and middle of the digester 10. This general ventilation combined with the local ventilation provided at the separate worksites by the air movers 48 shown in FIGS. 1 and 2 ensures that most of the polluted air is quickly removed from the digester 10 which allows work to proceed simultaneously at several different elevations.

While the description of the exhaust ventilation apparatus according to the invention has been given with respect to preferred embodiments, it will be evident that various other modifications are possible without departing from the scope of the invention as understood by those skilled in the art and defined in the following claims.

The embodiments of the invention in which an exclusive property or privilege is claimed is defined as follows:

1. An exhaust ventilation apparatus to be temporarily mounted in an elongated vessel having an outer casing to draw air from at least a selected one of several possible worksites in the vessel comprising;

(a) an exhaust duct to extend longitudinally in the vessel to an outlet opening in the outer casing of the vessel, the exhaust duct having a plurality of normally closed inlet ports spaced therealong, (b) at least one air collection conduit to extend from an inlet positioned adjacent said at least one selected worksite and connect to a convenient one of the inlet ports spaced along the exhaust duct, and (c) at least one venturi type air mover to be connected to the at least one air collection conduit between said inlet and said convenient one of the inlet ports, whereby air from said at least one selected worksite is continuously drawn into the exhaust duct through the at least one air collection conduit and exhausted out of the vessel through the exhaust duct outlet.

2. An exhaust ventilation apparatus as claimed in claim 1 wherein the at least one air mover is connected between the at least one air collection conduit and said convenient one of the inlet ports spaced along the exhaust duct, and the at least one air collection conduit has a plurality of branches each extending from a separate inlet mounted in a selected location.

3. An exhaust ventilation apparatus as claimed in claim 2 comprising a plurality of air collection conduits and a plurality of air movers, each of the air movers being connected between one of the air collection conduits and one of the inlet ports spaced along the exhaust duct, to draw air from a plurality of worksites in the vessel.

4. An exhaust ventilation apparatus as claimed in claim 3 wherein the vessel is elongated vertically with a top end and a bottom end, the exhaust duct extends vertically upwards to the outlet opening adjacent the rear end, and the air movers are each connected to different inlet ports spaced along the exhaust duct to draw air from worksites at different elevations in the vessel.

5. An exhaust ventilation apparatus as claimed in claim 4 further including another air mover connected to the exhaust duct at an inlet port near the top end of the vessel to provide general ventilation in the vessel.

* * * * *